US005184860A

United States Patent [19]

Bouillon et al.

[11] Patent Number: 5,184,860

[45] Date of Patent: Feb. 9, 1993

[54] MOTORIZED REMOTE-CONTROLLED LOAD GRIPPING DEVICE

[75] Inventors: Hubert Bouillon; Claude Dessaux, both of La Clayette, France

[73] Assignee: Potain (Societe Anonyme), Ecully, France

[21] Appl. No.: 667,904

[22] Filed: Mar. 12, 1991

[30] Foreign Application Priority Data

Mar. 12, 1990 [FR] France ..... 90 03841

[51] Int. Cl.[5] ..... B66C 1/66

[52] U.S. Cl. ..... 294/67.31; 294/86.41; 294/97; 294/106; 294/907

[58] Field of Search ..... 294/67.31, 67.5, 81.51, 294/82.32, 86.41, 88, 97, 106, 110.1, 111, 115, 902, 907; 901/36, 37, 39

[56] References Cited

U.S. PATENT DOCUMENTS

| | | | |
|---|---|---|---|
| 1,169,004 | 1/1916 | Cargin | 294/97 |
| 1,373,823 | 4/1921 | McClung | 294/97 X |
| 2,610,890 | 9/1952 | Jaeger | 294/110.1 |
| 2,857,193 | 10/1958 | Heppenstall | 294/67.31 |
| 2,951,725 | 9/1960 | St. Jean | 294/115 X |
| 3,044,819 | 7/1962 | Pierre | 294/81.51 X |
| 3,325,029 | 6/1967 | Rigsby | 294/115 X |
| 3,796,332 | 3/1974 | Kawamura | 294/106 X |
| 4,303,269 | 12/1981 | Faughman | 294/67.31 X |
| 5,071,184 | 12/1991 | Dessaux . | |

FOREIGN PATENT DOCUMENTS

| | | | |
|---|---|---|---|
| 214606 | 4/1961 | Austria | 294/115 |
| 0244322 | 11/1987 | European Pat. Off. . | |
| 2533076 | 2/1977 | Fed. Rep. of Germany . | |
| 2210563 | 12/1974 | France . | |
| 2511993 | 4/1983 | France . | |
| 2619800 | 3/1989 | France | 294/115 |
| 231795 | 9/1989 | Japan | 294/67.31 |
| 821383 | 4/1981 | U.S.S.R. | 294/67.31 |
| 1163986 | 9/1969 | United Kingdom | 294/115 |

*Primary Examiner*—Johnny D. Cherry
*Attorney, Agent, or Firm*—Browdy and Neimark

[57] ABSTRACT

The device comprises a gripper (15) whose arms (16, 17) hold at their free end an on-loading mechanism (18, 19) designed to engage a load (13) by gripping accessories (14). Two connecting rods (21, 22) constitute a deformable diamond with the upper part of the gripper (15). The lower ends of connecting rods (21, 22) are hinged to a shoulder (27) of a guide column (28) on which moves a slide (29) forming the head of the gripper (15). Two jacks (45, 46) control the opening and closing of the gripper (15). A connector arm (30) links the shoulder of column (28) to a turning grappling rope (10) and allows the center of gravity to be corrected by a jack (52). This gripping device is intended for use with raising devices such as turret slewing cranes.

11 Claims, 8 Drawing Sheets

MOTORIZED REMOTE-CONTROLLED LOAD GRIPPING DEVICE

BACKGROUND OF THE INVENTION

This invention pertains to the field of load handling, primarily on construction and public works sites. Its object is a motorized device for gripping heavy and bulky loads, such as wall forms, panels and prefabricated slabs, the device's functions of grasping and setting down loads being remote-controlled. This device is more particularly designed for cable raising devices such as turret slewing cranes or mounted cranes.

For said raising devices, it is a well-known practice to use hooks, grippers, claws and raising grapplers as gripping devices.

PRIOR ART

In the most common embodiments, the gripping device is directed and centered manually, while the load is grasped by slinging, or automatically by tightening when tension is applied to the lifting rope. Despite protective devices and safety measures, this type of operation always places the operator at bodily risk, whether this risk involves handling moving parts, or exists simply by virtue of his proximity to the load being handled.

For specific applications, there are automatic gripping devices which also center the load to be grasped, but this possibility is still limited. This is the case, for example, in the embodiment described in French Patent No. 2 511 993, wherein the grappler is endowed with two mobile bearings facilitating its positioning with respect to the rails to be handled. This is also true in the embodiment described in French Patent No. 2 210 563 wherein the gripping device comprises a hood designed to be hooked to a lifting unit whose lower part contains an embouchure in the shape of an overturned funnel, guided on a joining piece solid with the load to be handled.

OBJECT OF THE INVENTION

In both embodiments, centering requires fairly accurate preliminary positioning, and the final positioning cannot be adjusted; in this way, said two gripping devices cannot be adapted to the variety of loads to be handled on construction and public works sites, which have very different dimensions and sections, and which, because of their intrinsic resistance, must be endowed with at least two gripping accessories, having a spread ranging from 0.5 to 2.5 m. The center of gravity of these loads must also be positioned when they are handled.

SUMMARY OF THE INVENTION

This invention makes it possible to correct these problems by supplying a remote-controlled motorized load gripping device intended more specifically for cable lifting mechanisms designed in general to perform the centering, grasping and locking functions automatically on any type of load having gripping accessories with standard shape and spread, as well as the function of positioning the center of gravity.

The device according to the invention is advantageously designed to be combined with a motorized load rotating device with autonomous power supply as defined in U.S. Pat. No. 5,071,184 assigned to the Applicant.

The device according to the invention has a flat hinged structure with a vertical axis of symmetry constituting a deformable quadrilateral, and is characterized in that it comprises a combination of the following:

a gripper, whose arms hold an on-loading mechanism at their free end;

a set of two connecting rods constituting a deformable diamond with the upper part of the gripper;

a substantially vertical guide column whose shoulder accommodates the lower ends of the two connecting rods and on which moves a slide forming the head of the gripper;

a connector arm linking the shoulder of the guide column to a grappling rope mounted to turn around a vertical shaft;

independent motorized links to control the opening and closing of the gripper, positioning of the connector arm by pivoting, and centering and locking of the on-loading mechanisms; and energy feed and monitoring and control mechanisms, primarily for the motorized links.

According to the principle of the invention, the device is adapted in this way for automatic handling of loads equipped with standardized gripping accessories. In the initial state, the gripping device is fully folded up, and has a minimum horizontal space requirement, which allows it to access various points of site operations under optimal conditions.

In one embodiment of the invention, the two arms of the gripper are each composed of a main beam having a "V-"shaped section, open towards the inside of said gripper, and a tie rod placed inside the "V-"shaped section of the main beam, each of the arms constituting a deformable parallelogram whose four summits are represented by the hinges of the main beam and the tie rod to the slide, and the hinges of said elements to the support of the on-loading mechanism. The connecting rods are preferably hinged to the middle of the main beams of the gripper arms.

The gripping device according to the invention thus has a light, thin-hinged structure, although it is rigid and adequately protects the more fragile components. In particular, the main "V-"shaped section beams protect the motorization components for the opening and closing of the gripper, made, for example, in the form of two identical double-action jacks placed symmetrically on either side of the guide column and which, through hinges, connect the lower part of the slide to the arms of said gripper. The deformable diamond-shaped structure and the length selected for the gripper arms, equal to twice the side of the diamond, ensure that the displacement of the free ends of said arms, and thus of the on-loading mechanisms, is strictly horizontal.

According to another characteristic of the invention, the upper part of the guide column comprises a substantially horizontal bracket serving as a recovery support for a double-action jack, whose body is hinged in the middle to the upper part of the connector arm, and whose shaft is hinged at the end to said bracket.

Said arrangement ensures the positioning and correction of the center of gravity as a supplementary motorized function of the device.

The connector arm can be composed of two parallel side rails placed symmetrically on either side of the flat hinged structure, both side rails being hinged to the shoulder of the guide column and on the rotating grappling rope, and being interconnected by at least one brace placed above the hinged connection with the body of the jack.

According to one embodiment of the invention, the on-loading mechanisms are composed of supports whose upper part encompasses the hinges of the gripper arms, while their base forms a housing that encompasses the components that guide, grasp and lock the load on the gripping accessories.

The guide components advantageously form two lateral branches of the housing, each composed of a bore in which turns a partially-grooved shaft having a bent shaft fixed at the outlet of the bore, said shaft serving as a support of a guide ramp for the load gripping accessories, said grooved shaft meshing with a rack piston which moves axially in a cylinder, and whose course is selected to pivot the shaft from an inside horizontal position corresponding to the gripping of the load by the closing of the gripper, to an outside horizontal position corresponding to the gripping of the load by the opening of the gripper, passing through an intermediary vertical storage or resting position, preferably held at a recess in the grooved shaft, in which a ball pushed by a spring can be partially engaged. In this way, a gripping device for universal use is made, which makes it possible not only to grasp loads endowed with gripping accessories having a spread that can vary, for example, from 0.5 to 2.5 m, but also allows loads to be grasped using two methods, either from the inside, or from the outside, the grasping mode being selected primarily depending on the environment. Moreover, the resting or storage position of guide shafts endowed with ramps ensures that these fairly vulnerable components are protected when not in use, and also makes it possible to limit the space requirement of this device. According to a complementary arrangement, the components to grasp and lock the load form the central part of the housing, composed of a bore in which turns a partially-grooved shaft, said shaft having two pyramid-shaped bolts attached to its ends, said bolts designed to cooperate with openings of the load gripping accessories, said grooved shaft meshing with a rack piston which moves axially in a cylinder and whose course is selected to pivot the bolts 90° from an unlocked position to a locked position, identified respectively by two sensors, for example, magnetic, placed 90° apart on the periphery of the bore, and cooperating with a blind orifice in the body of the grooved shaft.

BRIEF DESCRIPTION OF THE DRAWINGS

In any event, the invention will be more clearly understood through the following description, in reference to the accompanying schematic drawings which, as an non-restrictive example, shows an embodiment of said remote-controlled motorized load gripping device.

PREFERRED EMBODIMENT OF THE INVENTION

Figure 1:
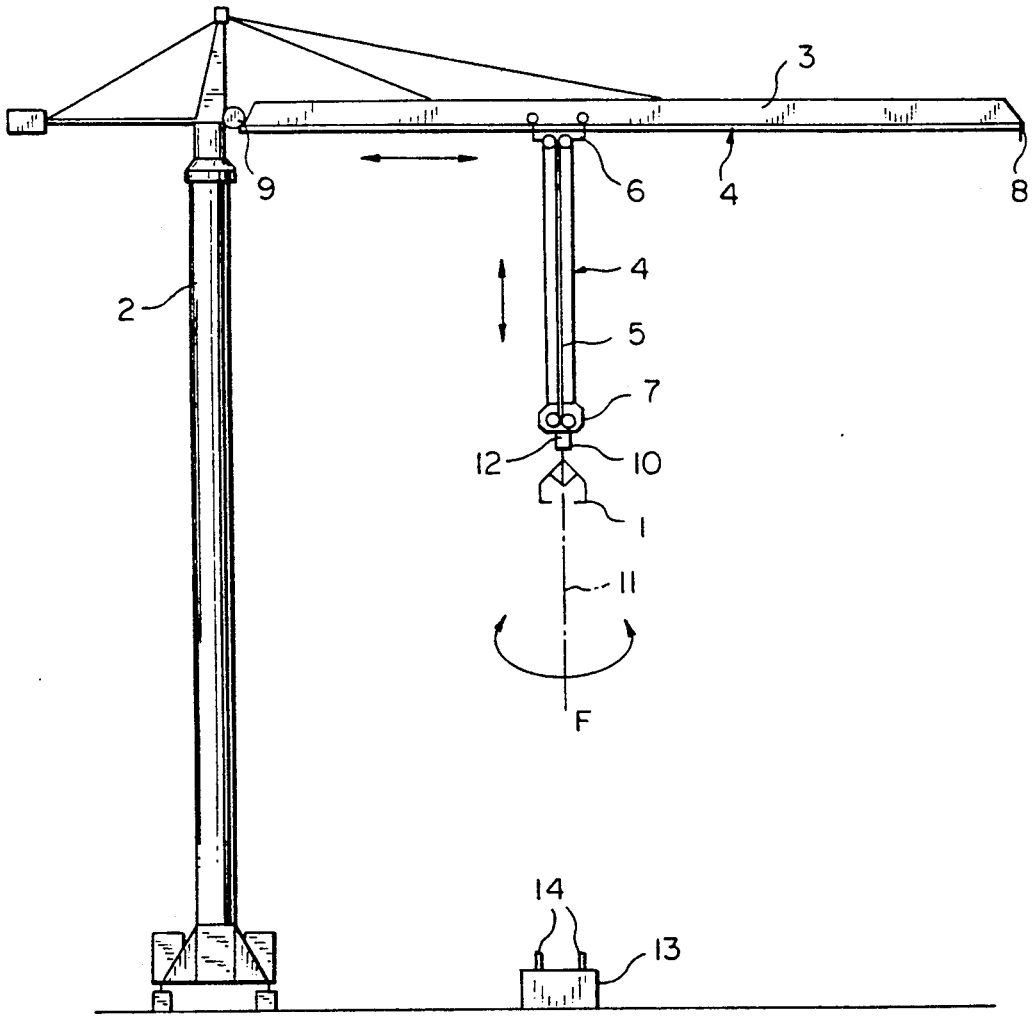
FIG. 1 shows a turret slewing crane with distributing boom endowed with a gripping device according to the invention.

As shown in FIG. 1, the gripping device according to the invention, generally designated with reference 1, is designed to function in cooperation with lifting devices such as a turret slewing crane 2 with distributing boom 3. Gripping device 1 is suspended from boom 3 of crane 2 through the intermediary of a lifting rope 4 forming a block and tackle 5 between distribution carriage 6 and a pulley block 7. At one end, lifting rope 4 is attached at a point 8 at the head of boom 3; at the other end, cable 4 winds on the barrel of a winch 9 placed at the foot of boom 3. Pulley block 7 comprises a grappling rope 10 mounted to turn around a vertical axis 11 and motorization to drive grappling rope 10 around vertical axis 11 as indicated by an arrow "F."

Gripping device 1 is suspended from grappling rope 10 by means of a horizontal shaft 12, and is endowed with the necessary mechanisms to ensure the automatic handling of a load 13 endowed with standardized gripping accessories 14.

Figures 2, 19:
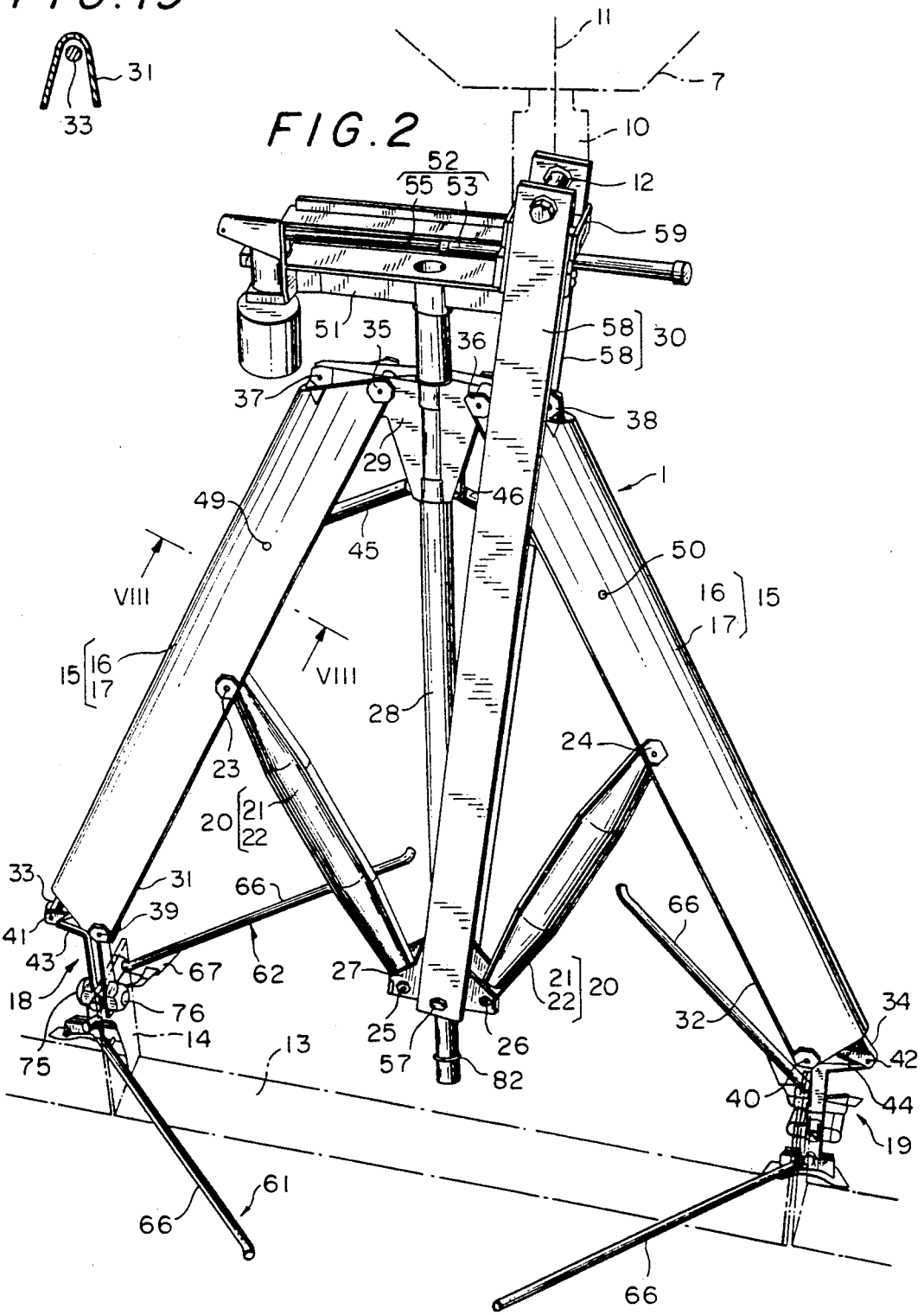
FIG. 2 is an overall perspective view of the gripping device.
FIG. 19 is a cut view along section VIII—VIII in FIG. 2.
Figure 3:
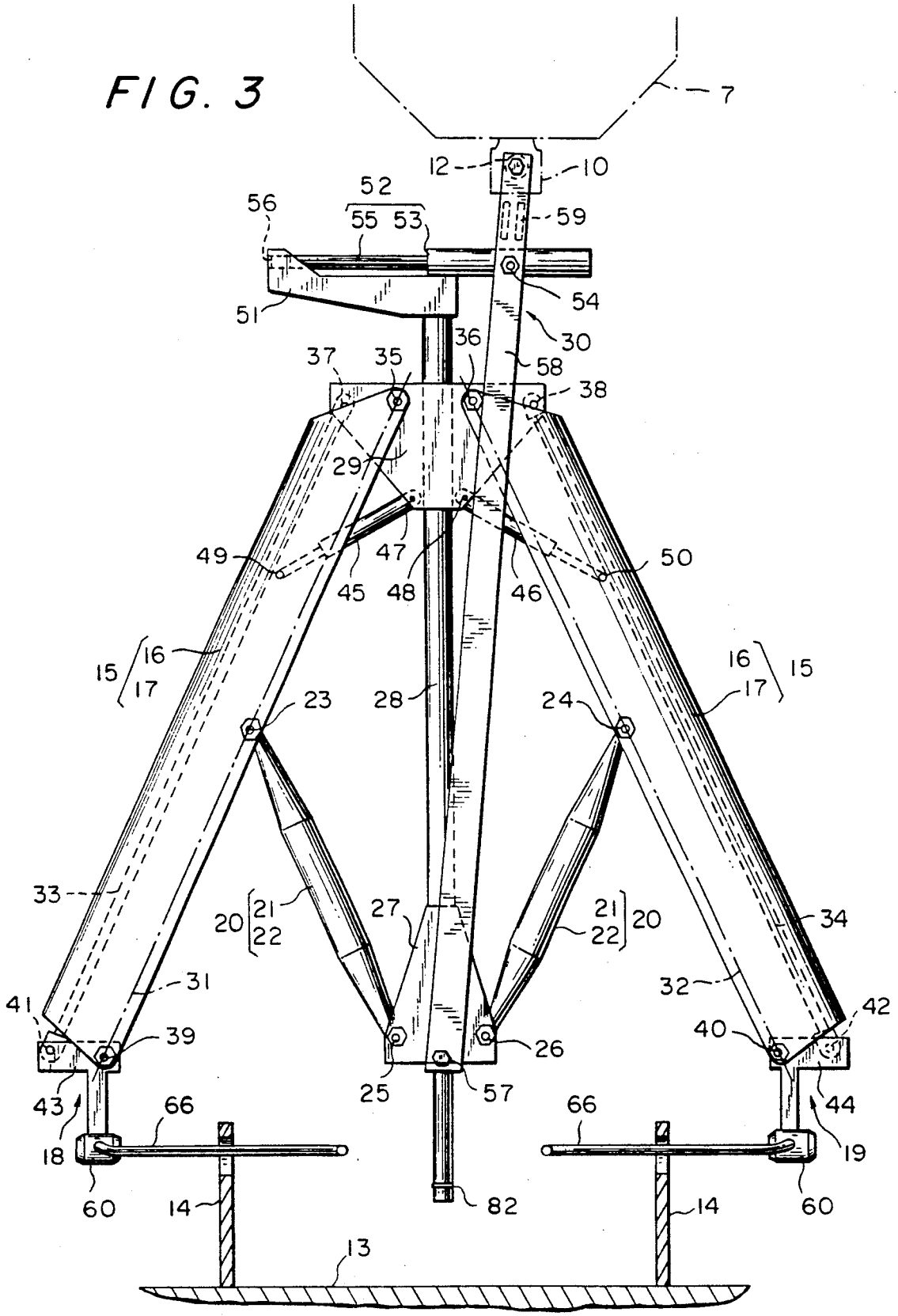
FIG. 3 is an overall lateral view of the same gripping device.

With reference in particular to FIGS. 2 and 3, gripping device 1 is in the form of a flat hinged structure located in a substantially vertical plane and composed of a gripper 15, whose two arms 16, 17 have, at their respective lower ends, on-loading mechanisms 18, 19 and a unit 20 of two connecting rods 21, 22, whose first end is hinged in 23, 24 to the central part of arms 16, 17 of gripper 15, while the other end is hinged in 25, 26 to shoulder 27. Shoulder 27 is fixed to substantially vertical column 28 which carries a slide connector 29 to which the upper ends of arms 16 and 17 are rotatably connected so that the arms move with slide connector 29.

Gripping device 1 further comprises a double connector arm 30, linking shoulder 27 of column 28 to grappling rope 10 of pulley block 7.

Arms 16, 17 of gripper 15 are each composed of a main beam 31, 32 having a "V-"shaped cross-section, open towards the inside of said gripper 15. A tie rod 33, 34 is placed inside the "V" of main beams 31, 32. Each of arms 16, 17 constitutes a deformable parallelogram whose four summits are represented by hinges 35, 36, 37, 38 of main beams 31, 32, and tie rods 33, 34 on slide connector 29, and hinges 39, 40, 41, 42 of said elements 31, 32, 33, 34 on a support 43, 44 of on-loading mechanisms 18, 19.

According to a complementary characteristic, gripper 15 and unit 20 of two connecting rods 21, 22 comprise a deformable diamond so that, in operation, on-loading mechanisms 18, 19 move in a substantially horizontal plane containing hinges 25, 26 and 39–42. The opening or closing of gripper 15 is ensured by two identical double-action hydraulic jacks 45, 46 placed symmetrically on both sides of column 28, connecting, by means of hinges 47, 48 to the lower part of slide connector 29 on the one hand and 49, 50, to the respective main beams 31, 32 of the arms 16, 17 of said gripper 15 on the other hand.

A substantially horizontal bracket 51 is attached to the upper end of guide column 28 of slide connector 29.

said bracket being located in the plane of the hinged structure and serving in the recovery of a double-action hydraulic jack 52, whose body 53 is connected in the middle by a hinge 54 to the upper part of double connector arm 30, and whose shaft 55 is hinged at 56 to the free end of bracket 51.

Double action jack 52 ensures an angular spring movement of connector arm 30 around its hinge axis 57, on shoulder 27 of slide connector 29 which guides column 28. Said connector arm 30 is composed of two parallel side rails 58 placed symmetrically on either side of the flat hinged structure of gripping device 1, and connected rigidly between jack 52 and their hinge 12 to grappling rope 10 of pulley block 7, through the intermediary of braces 59.

Figure 4:
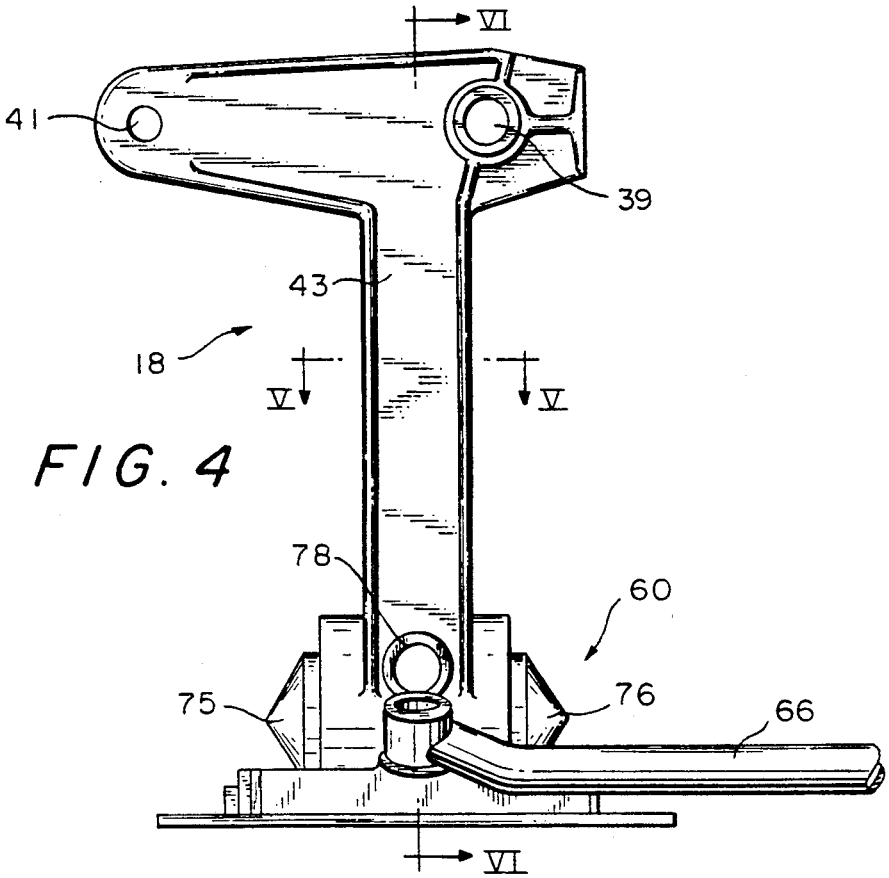
FIG. 4 is a detailed view of the on-loading mechanism of this device.
Figure 5:
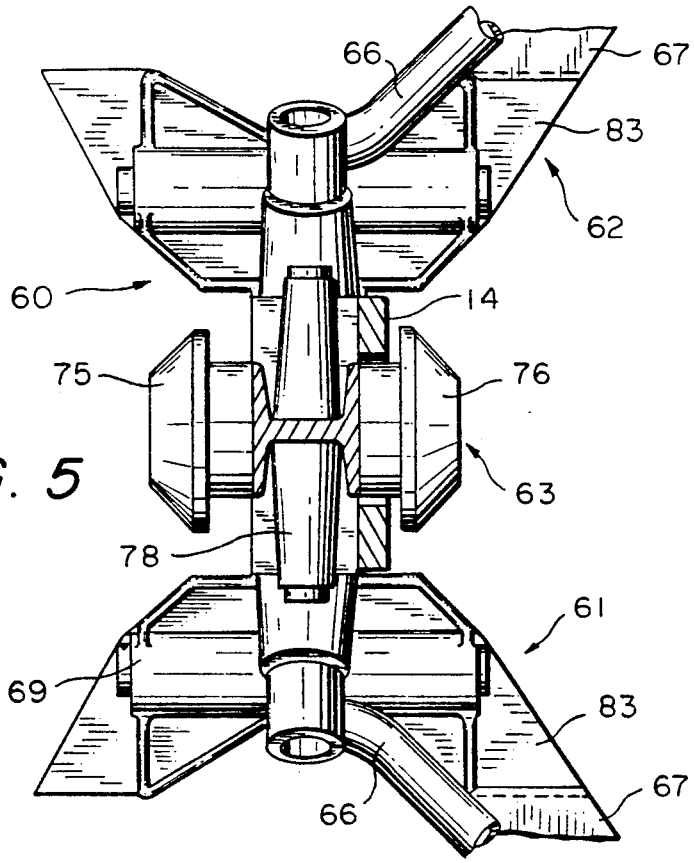
FIG. 5 is a cut view along V—V in FIG. 4.
Figure 6:
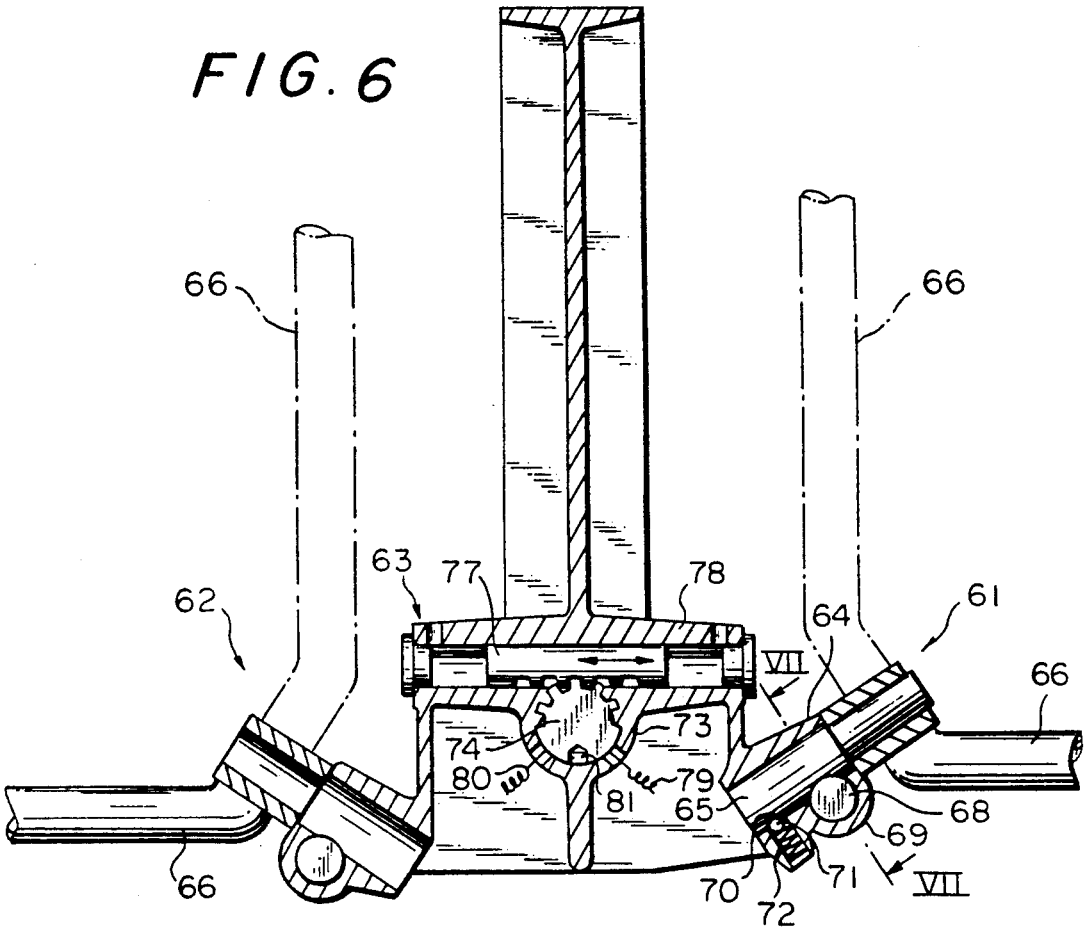
FIG. 6 is a cut view along VI—VI in FIG. 4.

As shown in detail in FIGS. 4 to 6, each on-loading mechanism 18 or 19 is composed of support 43, whose upper part includes hinges 39, 41 of arm 16 or hinges 40, 42 of arm 17 of gripper 15, while the base of said support forms a housing 60 which encompasses the components to guide, grasp and lock load 13 on gripping accessories 14.

The guide components form two lateral branches 61, 62 of housing 60, while the grasping and locking components form the central part 63 of said housing 60.

Figure 7:
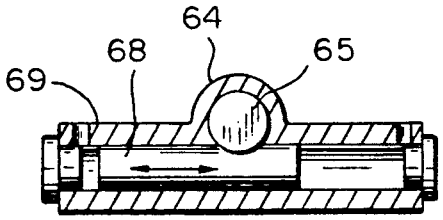
FIG. 7 is a partial cut view along VII—VII in FIG. 6.

As shown in FIGS. 6 and 7, lateral branch 61 or 62 of housing 60 is composed of a bore 64, having an axis inclined on the horizontal plane, inside which turns a partially-grooved shaft 65, said shaft having attached to its outlet a bent shaft 66 serving as a support for a guide ramp 67 for gripping accessories 14. FIG. 7 is a detailed view of the pivoting control of shaft 66; grooved shaft 65 meshes with rack piston 68, moving axially in a cylinder 69 and the course of piston 68 is determined to pivot guide shaft 66 from an extreme inside horizontal position corresponding to the gripping of load 13 by the closing of gripper 15, to an extreme outside horizontal position corresponding to a gripping of load 13 by the opening of gripper 15, passing through an intermediary vertical resting position shown in FIG. 6. Also as shown in FIG. 6, the two guide components 61, 62 are mutually offset heightwise, so that their guide shafts 66, 66 can slide under each other, i.e., those of on-loading mechanism 18 slide on those of other on-loading mechanism 19 when the gripping accessories 14 of load 13 are a short distance apart.

According to a complementary characteristic, grooved shaft 65 has a recess 70 in which a ball 71 pressed by a spring 72 can become engaged to hold guide shaft 66 in vertical resting position.

Figure 8:
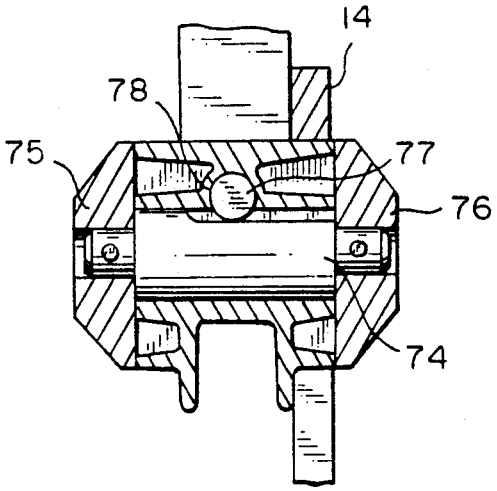
FIGS. 8 and 9 show a cut view of the locking system in unlocked position.
Figure 10:
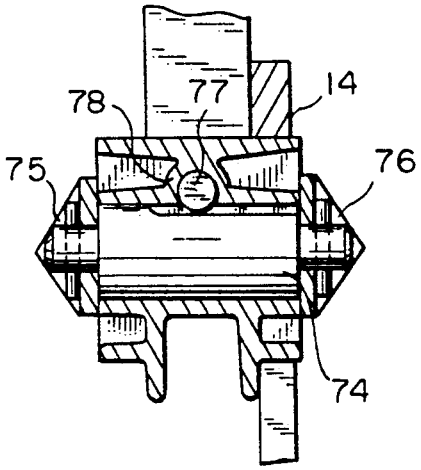
FIGS. 10 and 11 show a cut view of the locking system in locked position.
Figure 9:
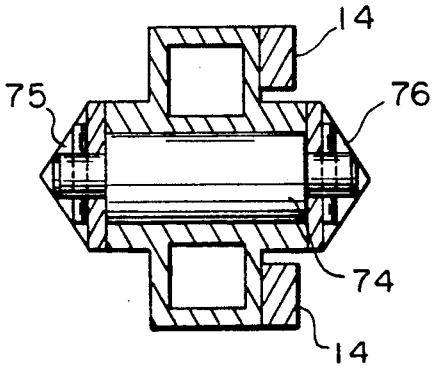
Figure 11:
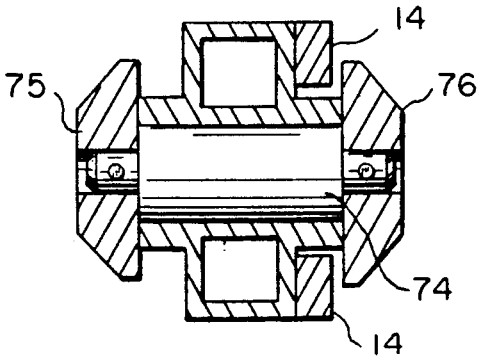

Central part 63 of housing 60 is composed of a bore 73 in which turns a partially-grooved shaft 74, said shaft having attached to its ends two pyramid-shaped bolts 75, 76 designed to cooperate with openings in accessories 14 to grip load 13. Bolts 75, 76 are controlled by a rack piston 77 meshing with grooved shaft 74 and moving axially in cylinder 78. The course of piston 77 is designed to pivot bolts 75, 76 90° from an unlocked position shown in FIGS. 8 and 9 to a locked position shown in FIGS. 10 and 11. Magnetic sensors 79, 80 placed 90° apart on bore 73 make it possible to detect the locking and unlocking positions when said magnetic sensors 79, 80 are opposite a blind orifice 81 in the body of shaft 74.

As an example, FIGS. 12 to 18 show various operating phases of the gripping device according to the invention for automatically handling a load 13 endowed with standardized gripping accessories 14.

Figure 12:
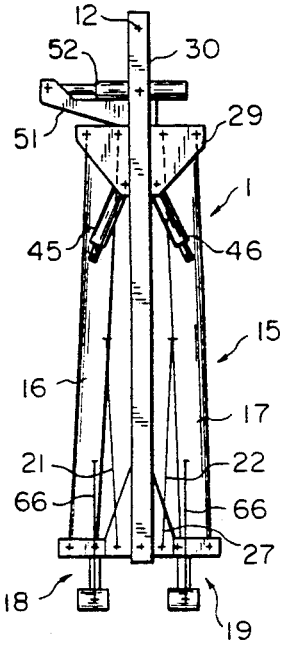
FIGS. 12 to 18 are schematic representations of different operating phases of the gripping device.

As shown in FIG. 12, in the initial state, gripping device 1 is completely folded up, thus creating a minimum horizontal space requirement allowing it to access the various points of operation on the site under optimal conditions. In this configuration, the lifting unit, such as the turret slewing crane 2 in FIG. 1, performs empty handling of gripping device 1 installed on turning grappling rope 10 of pulley block 7, from which it receives its electricity and command orders, gripping device 1 using electro-hydraulic energy.

When gripping device 1 reaches the position over load 13, the crane operator orients it approximately according to the position of gripping accessories 14 by rotating turning grappling rope 10 of pulley block 7, and deployed by controlling jacks 45, 46 opening gripper 15.

Figure 13:
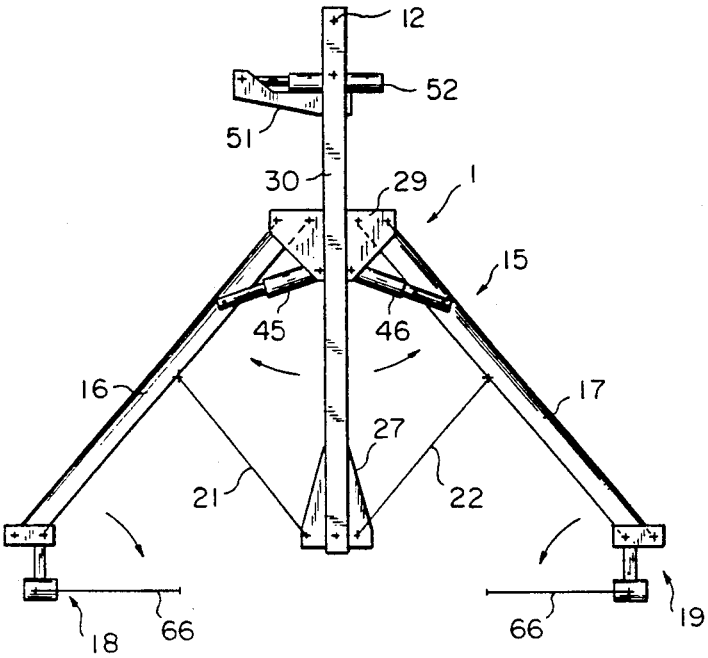

When gripping device 1 has been opened sufficiently, the crane operator moves rack pistons 68 to pivot guide shafts 66 from vertical resting position to inside horizontal position as shown in FIG. 13.

Through the use of an optical or other type of sensor 82 placed under shoulder 27 of guide column 28, the gripping plane is detected during the final slow descent of gripping device 1 by the presence in this plane of gripping accessories 14 advantageously endowed with receiving mechanisms for their identification.

Figure 14:
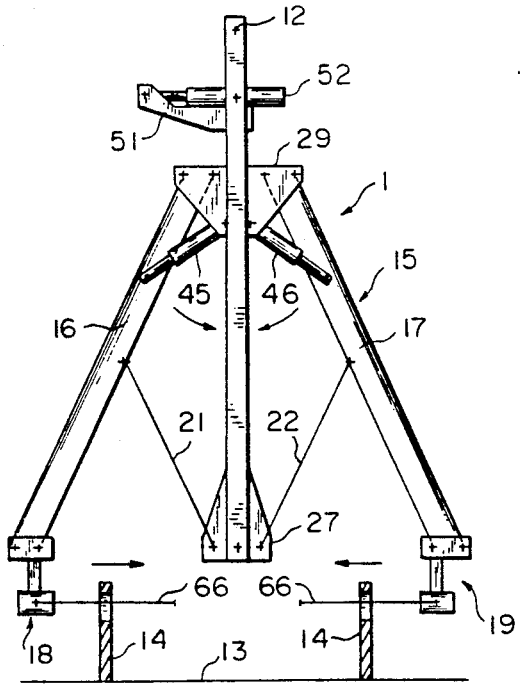

The height adjustment having been made, the crane operator closes gripper 15 as shown in FIG. 14.

During this phase, guide shafts 66 and ramps 67 automatically center gripping device 1 over load 13. At the end of the course, centering is ensured by the plates 83 of housing 60 itself.

Figure 15:
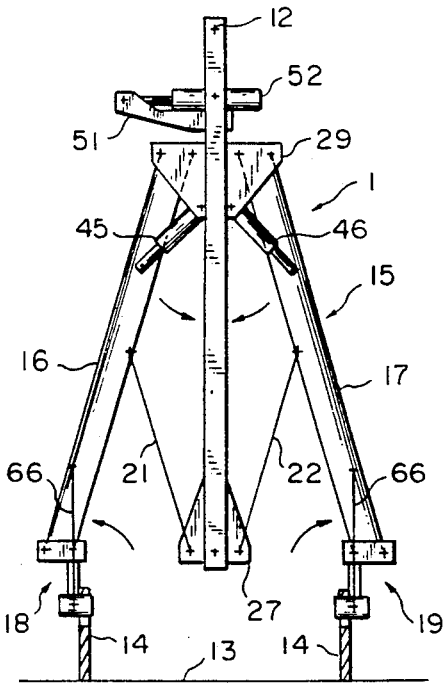
Figure 16:
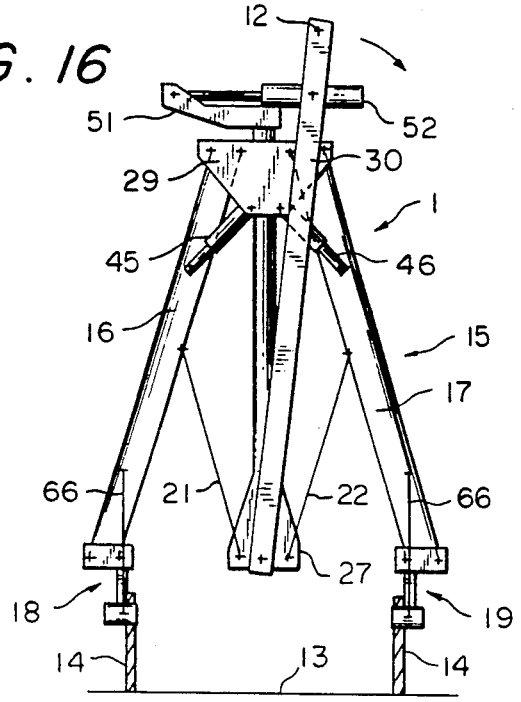

When the centering device reaches its limit, the crane operator moves pistons 77, to pivot bolts 75, 76 introduced at that time though openings in gripping accessories 14, thus locking load 13. In this position, guide shafts 66 are returned to vertical position as shown in FIG. 15. The crane operator also seeks the center of gravity of load 13 by pivoting double connector arm 30 through the intermediary of jack 52; control can be performed by an inclinometer (not shown—see FIG. 16). Load 13 being effectively balanced, the crane operator then handles said load 13 and places it at the desired destination. Finally, the crane operator re-centers gripping device 1 and releases load 13 by reversing the procedures defined above.

Figure 17:
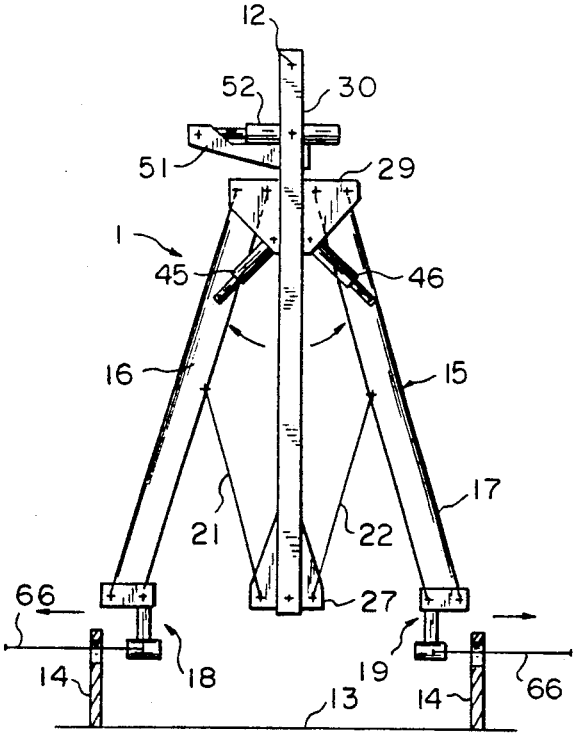
Figure 18:
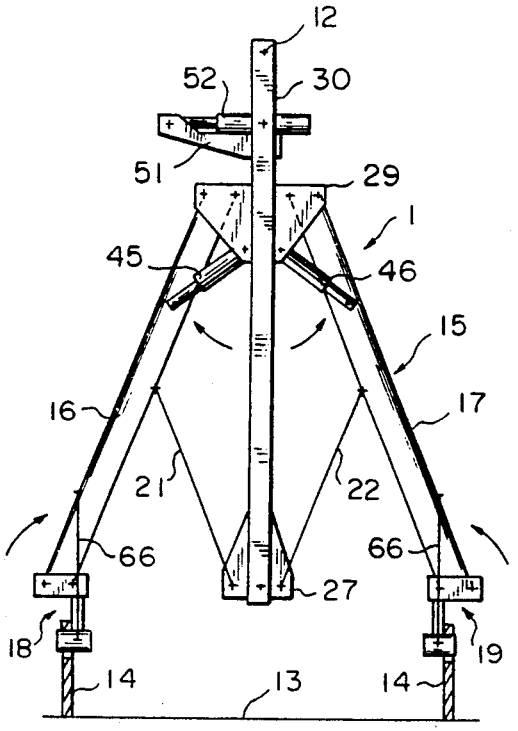

FIGS. 17 and 18 illustrate the possibility of grasping a load 13 endowed with the same standardized gripping accessories 14 from the inside rather than the outside. The load is grasped from the inside by opening gripper 15, whereas said gripper is closed when grasping from the outside.

Thus is created a remote-controlled motorized load gripping device which automatically performs centering, grasping and locking functions for any type of load 13 having gripping accessories 14 of standardized shape and spread; it also positions the center of gravity. Furthermore, device 1 makes it possible to grip loads 13 inclined on the horizontal plane due to improperly-levelled terrain or a declivity of the storage area, loads being adapted to a potential incline by action on jack 52 which controls the pivoting of connector arm 30. Furthermore, it can be noted that said gripping device 1 can be used as a lifting beam by providing points of attachment for handling slings.

Of course, the invention is not limited solely to the embodiment of said motorized remote-controlled load gripping device described above as an example; on the contrary, it encompasses all other variations of embodiments and applications following the same principles. In particular, we would not depart from the framework of the invention:

by replacing the jacks and rack pistons with other electrically-, hydraulically- or pneumatically-controlled units motorizing the functions of the device;

by modifying constructive details such as the position of the jacks;

by adapting said device to lifting units other than cranes, even those without lifting ropes;

by doubling the gripping points, i.e., by adapting the device to grip loads endowed with two pairs of gripping accessories.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A motorized remote-controlled load gripping device for cable lifting mechanisms such as a turret slewing crane (2) having a distributing boom (3), said device being a flat hinged structure having a vertical axis of symmetry constituting a deformable quadrilateral, said device comprising:

a gripper (15) having two arms (16, 17), said arms having an on-loading mechanism (18, 19) at a first end of each of said arms;

a unit (20) having two connecting rods (21, 22) creating a deformable diamond shape with an upper part of said gripper (15);

a substantially-vertical guide column (28) connected to a shoulder (27), lower ends of said two connecting rods (21, 22) rotatably connected to said shoulder, a slide connector (29) slidably engaged to said guide column (28), a second end of each of said arms rotatably connected to said slide connector (29);

a connector arm (30) linking said shoulder (27) and said guide column (28) to a grappling rope (10), said grappling rope turning around a vertical axis (11), first, second and third motorized control link means respectively located between said guide column and said arms, between said connector and said gripper, and on said on-loading mechanism (45, 46, 52, 65, 68, 74, 77), for respectively opening and closing of said gripper (15), positioning of said connector arm (30) by pivoting, and centering and locking of said on-loading mechanism (18, 19), and electricity supply, monitoring and control means, for said motorized control link means.

2. Motorized load gripping device according to claim 1, wherein said two arms (16, 17) of said gripper (15) are each composed of a main beam (31, 32) having a v-shaped cross-section open towards the inside of said gripper (15), a tie rod (33, 34) placed inside of said v-shaped cross section of said main beam (31, 32), each of said arms (16, 17) having a deformable parallelogram formed by first hinges (35, 36, 37, 38) on said main beam (31, 32) and said tie rod (33, 34) on said slide connector (29) and second hinges (39, 40, 41, 42) on said main beam and said tie rod (31, 32, 33, 34) and on a support (43, 44) of said on-loading mechanism (18, 19).

3. Motorized load gripping device according to claim 2, wherein said connecting rods (21, 22) are hinged to the center (23, 24) of said main beams (31,32) of said arms (16, 17) of said gripper (15).

4. Motorized load gripping device according to claim 3, wherein said first motorized control link means for opening and closing of said gripper (15) are in the form of two identical double-action jacks (45, 46) placed symmetrically on both sides of said guide column (28) and, through third hinges (47, 48, 49, 50) connect a lower part of said slide connector (29) to said arms (16, 17) of said gripper (15).

5. Motorized load gripping device according to claim 4, wherein said guide column (28) comprises at an upper part a substantially horizontal bracket (51) serving as a support for a double-action jack (52) having a body portion (53) hinged at a middle (54) to an upper part of said connector arm (30) and a shaft (55) hinged at an end (56) to said bracket (51).

6. Motorized load gripping device according to claim 5, wherein said connector arm (30) is composed of two parallel side rails (58) placed symmetrically on either side of said flat hinge structure, said two side rails (58) being hinged (57) to said shoulder (27) of said guide column (28) and (in 12) to a turning grappling cable (10), and being interconnected by at least one brace (59) placed above said middle (54) of said body portion (53) of said jack (52).

7. Motorized load gripping device according to claim 6, wherein said load gripping mechanisms (18, 19) are composed of said support (43, 44) having an upper part including said second hinges (39, 40, 41, 42) of said arms (16, 17) of said gripper (15), while a base of said support forms a housing (60) which encompasses guide components, grasp components and lock components to manipulate a load (13) by gripping accessories (14).

8. Motorized load gripping device according to claim 7, wherein said guide components form two lateral branches (61, 62) of said housing (60), each of said two lateral branches composed of a bore (64) in which turns a partially grooved shaft (65), leading to an outlet at which is attached a bent shaft (66) serving as a support for a guide ramp (67) into said gripping accessories (14) and which grip said load (13), said grooved shaft (65) meshing with a rack piston (68) which moves axially in a cylinder (69) to pivot said bent shaft and said guide ramp (66, 67) from an inside horizontal position corresponding to a gripping of said load (13) by closing said gripper (15), to an outside horizontal position corresponding to a gripping of said load by opening said gripper (15), said partially grooved shaft having a resting position, at which it is held by a ball (71) pushed by a spring (72) partially engaged in a recess in said partially grooved shaft (65).

9. Motorized load gripping device according to claim 8, wherein said grasp components and said lock components form a central part (63) of said housing (60), said central part (63) composed of a bore (73) in which turns a partially grooved shaft (74) at the ends of which are attached two pyramid-shaped bolts (75, 76) designed to cooperate with openings of said gripping accessories (14) for said load (13), said grooved shaft (74) meshing with a rack piston (77) which moves axially in a cylinder (78) to pivot said bolts (75, 76) 90° from an unlocked position to a locked position, said unlocked position and said locked position being detected respectively by two magnetic sensors (79, 80) placed 90° apart on a periphery of said bore (73) and cooperating with a blind orifice (81) in the body of said grooved shaft (74).

10. Motorized load gripping device according to claim 9, wherein said guide components (61, 62) are mutually offset heightwise, so that their respective said bent shaft and said guide ramp (66, 67) can slide over each other when said load (13) and said gripping accessories (14) are a short distance apart.

11. Motorized load gripping device according to claim 1, wherein said grappling rope (10) is a part of a pulley block (7) having a motorized device with an autonomous energy supply to drive said grappling rope (10) in rotation around said vertical axis (11) said gripping device (1) receiving its energy and its command orders from said grappling rope (10).

* * * * *